US011180930B2

(12) United States Patent
Leung et al.

(10) Patent No.: US 11,180,930 B2
(45) Date of Patent: Nov. 23, 2021

(54) HOUSEHOLD ELECTRIC AND MECHANICAL DUAL-CONTROLLED INTELLIGENT LOCK

(71) Applicant: Yan Shun Leung, Hong Kong (CN)

(72) Inventors: Yan Shun Leung, Hong Kong (CN); Lok Shun Leung, Hong Kong (CN)

(73) Assignee: Yan Shun Leung, Hong Kong (CN)

( * ) Notice: Subject to any disclaimer, the term of this patent is extended or adjusted under 35 U.S.C. 154(b) by 521 days.

(21) Appl. No.: 16/321,448

(22) PCT Filed: Sep. 29, 2018

(86) PCT No.: PCT/CN2018/108682

§ 371 (c)(1),
(2) Date: Jan. 28, 2019

(87) PCT Pub. No.: WO2019/062292

PCT Pub. Date: Apr. 4, 2019

(65) Prior Publication Data

US 2021/0332609 A1 Oct. 28, 2021

(30) Foreign Application Priority Data

Sep. 29, 2017 (CN) ..... 201710905007.1

(51) Int. Cl.
*E05B 47/00* (2006.01)
*E05B 9/08* (2006.01)

(52) U.S. Cl.
CPC ..... *E05B 47/0012* (2013.01); *E05B 9/08* (2013.01); *E05B 2047/002* (2013.01);
(Continued)

(58) Field of Classification Search
CPC ..... E05B 47/0012; E05B 9/08; E05B 2047/0054; E05B 2047/0086;
(Continued)

(56) References Cited

U.S. PATENT DOCUMENTS 4,438,962 A * 3/1984 Soloviff ..... E05B 47/0012 292/144
4,745,785 A * 5/1988 Uebersax ..... E05B 47/0012 70/279.1
(Continued)

FOREIGN PATENT DOCUMENTS

CN 102287088 A 12/2011
CN 104100146 A 10/2014
(Continued)

*Primary Examiner* — Lloyd A Gall

(57) ABSTRACT

A household electric and mechanical dual-controlled intelligent lock includes a mechanical clutching structure and an intelligent electronic control structure. The mechanical clutching structure includes a locking head, a springback lock tongue, a first round rotary table and a fixed seat, wherein: an end portion of the springback lock tongue extends outside the fixed seat, an arched guide rail which is fitted with the first round rotary table is located on the springback lock tongue. The intelligent electronic control structure includes a PCB (printed circuit board), a motor, a scalable suite and a second round rotary table, wherein: one end of the scalable suite is fixedly connected with the motor, the other end of the scalable suite is fixedly connected with the second round rotary table, an arched guide rail which is fitted with the second round rotary table is located on the other surface of the springback lock tongue.

6 Claims, 4 Drawing Sheets

(52) U.S. Cl.
CPC ..... *E05B 2047/0026* (2013.01); *E05B 2047/0054* (2013.01); *E05B 2047/0086* (2013.01)

(58) Field of Classification Search
CPC ..... E05B 2047/002; E05B 2047/0026; E05B 2047/0024
USPC ..... 70/222, 223, 277, 278.1–278.3, 278.7, 70/279.1, 280–283, 283.1; 292/144
See application file for complete search history.

(56) References Cited

U.S. PATENT DOCUMENTS

| | | | | |
|---|---|---|---|---|
| 6,022,056 | A * | 2/2000 | Cope | E05B 17/22 292/144 |
| 6,585,302 | B2 * | 7/2003 | Lin | E05B 47/0012 292/142 |
| 7,455,335 | B2 * | 11/2008 | Garneau | E05B 47/0012 292/144 |
| 2012/0073338 | A1 * | 3/2012 | Mohla | E05B 47/0012 70/124 |
| 2016/0123039 | A1 * | 5/2016 | Roatis | E05B 47/0607 70/78 |
| 2017/0247912 | A1 * | 8/2017 | Ando | E05B 47/0012 |

FOREIGN PATENT DOCUMENTS

| | | |
|---|---|---|
| CN | 204476011 U | 7/2015 |
| CN | 105962737 | 9/2016 |

* cited by examiner

HOUSEHOLD ELECTRIC AND MECHANICAL DUAL-CONTROLLED INTELLIGENT LOCK

CROSS REFERENCE OF RELATED APPLICATION

This is a U.S. National Stage under 35 U.S.C 371 of the International Application PCT/CN2018/108682, filed Sep. 29, 2018, which claims priority under 35 U.S.C. 19(a-d) to CN 201710905007.1, filed Sep. 29, 2017.

BACKGROUND OF THE PRESENT INVENTION

Field of Invention

The present invention relates to the technical field of daily hardware, and more particularly to a household electric and mechanical dual-controlled intelligent lock.

Description of Related Arts

In today's life, the letter box has become an essential item in daily life, but when the letter box is used, whether there is a letter in the letter box or not, people have to open the letter box every day to take a look, which is very time-consuming and laborious. In order to cooperate with the development of smart Internet of Things and big data, owners will consider upgrading the building's smart facilities and security standards, such as adding smart door locks, smart letter boxes and smart lifts.

In general, traditional standard independent mechanical locks are used in homes, offices, school drawers, lockers or storage boxes. In the market, there is no lock that can replace this traditional standard lock with an intelligent controlled and managed lock. This intelligent drawer and door lock can be easily replaced in the original position. It is an adaptively mounted electric or key double-control smart lock, does not need to be wired or installed to control the host, and is appropriate in installation cost. The user can quickly install this smart lock.

With the rapid development of the Internet, smart phones have become a necessity in life, and the intelligent access control system has also developed. Many electronically controlled door locks, fingerprint locks, etc. can be used with smart phones. Since human inertia is not replaced by full intelligence, when developing new smart products, the inventors of the present invention first consider whether the product meets the needs of different age groups, such as the elderly or users who have not yet used a smartphone. Therefore, in addition to being compatible with the existing traditional key unlocking method, the present design can be optimized during use, and can be manipulated with a more convenient smart phone without contradiction in use.

SUMMARY OF THE PRESENT INVENTION

In view of deficiencies in the above technologies, the present invention provides a household electric and mechanical dual-controlled intelligent lock which is able to be intelligently transformed on the basis of the existing mechanical lock cylinders.

To achieve the above object, the present invention provides a household electric and mechanical dual-controlled intelligent lock, which comprises a mechanical clutching structure and an intelligent electronic control structure, wherein:

the mechanical clutching structure comprises a locking head, a springback lock tongue, a first round rotary table and a fixed seat, wherein: the springback lock tongue is fixed on the fixed seat, an end portion of the springback lock tongue extends outside the fixed seat, a first arched guide rail which is fitted with the first round rotary table is located on one surface of the springback lock tongue, the locking head is connected with the springback lock tongue through the first round rotary table, so that when a key is inserted into the locking head for rotating to drive the first round rotary table to rotate, the end portion of the springback lock tongue is retracted into the fixed seat;

the intelligent electronic control structure comprises a PCB (printed circuit board), a motor, a scalable suite and a second round rotary table, wherein: the PCB is electrically connected with the motor, one end of the scalable suite is fixedly connected with the motor, the other end of the scalable suite is fixedly connected with the second round rotary table, a second arched guide rail which is fitted with the second round rotary table is located on the other surface of the springback lock tongue; the PCB controls the motor to work, the scalable suite drives the second round rotary table to rotate, so that the end portion of the springback lock tongue is retracted into the fixed seat.

Preferably, the mechanical clutching structure further comprises two reset springs; wherein: the fixed seat has two spring grooves for respectively installing the two reset springs, two convex columns are respectively located at two side walls of the springback lock tongue for holding the two reset springs, one end of each of the two reset springs presses against a groove wall of one of the two spring grooves, the other end of each of the two reset springs is sleeved outside one of the two convex columns and presses against one of the two reset springs, so that when the two reset springs are compressed, the end portion of the springback lock tongue is retracted into the fixed seat; when the two reset springs are stretched; the end portion of the springback lock tongue extends outside the fixed seat.

Preferably, a first positioning bulge which is fitted with the springback lock tongue is located at one surface of the first round rotary table, a square slot which is fitted with the locking head is provided on the other surface of the first round rotary table; a second positioning bulge which is fitted with the springback lock tongue is located at one surface of the second round rotary table, an inner threaded structure which is fitted with the scalable suite is located on the other surface of the second round rotary table.

Preferably, the scalable suite comprises an outer suite and an inner suite; wherein: the outer suite has a columnar structure which is round outside but square inside, an external surface of the inner suite is a square surface which is fitted with an inner surface of the outer suite, one end portion of the outer suite has an inner gear structure which is fitted with the motor, an end portion of the inner suite which is opposite to the outer suite has an outer threaded structure fitted with the second round rotary table.

Preferably, the intelligent electronic control structure further comprises a panel casing and a bottom casing, wherein the PCB, the motor, the scalable suite and the second round rotary table are accommodated within a cavity which is formed by enclosing the panel casing and a bottom casing; the panel casing has a through-hole for allowing the second round rotary table to pass through; the fixed seat is fixed to an external surface of the panel casing through removable screws, the second round rotary table passes through the through-hole and then is snapped into the second curved guide rail located on the springback lock tongue.

Preferably, the intelligent electronic control structure further comprises a left baffle and a right baffle which are respectively fixed at two sides of the panel casing, two peak-shaped bumps are respectively located at an external surface of the left baffle and the right baffle; two peak-shaped slots which are respectively fitted with the two peak-shaped bumps of the left baffle and the right baffle are provided on two side walls of the bottom casing, the bottom casing is accurately fixedly connected with the panel casing through inserting the left baffle and the right baffle into the bottom casing.

Preferably, the intelligent electronic control structure further comprises a battery, the panel casing has a battery slot, the battery is inserted into the battery slot and is electrically connected with the PCB, a battery cover is located above the bottom casing for easily replacing the battery, the battery cover is in removable fixed connection with the bottom casing.

Preferably, the intelligent electronic control structure further comprises a lamp holder which comprises an LED (light emitting diode) indicator lamp, an infrared distance sensor, a photometric sensor and a control button, wherein the LEI) indicator lamp, the infrared distance sensor, the photometric sensor and the control button are electrically connected with the PCB and extend outside a surface of the bottom casing.

Preferably, the PCB comprises an information sending module for sending a letter prompt message to an external mobile intelligent terminal, a wireless connection module is a Bluetooth connection module or a LAN connection module.

Beneficial effects of the present invention are as follows.

Compared with the prior art, the intelligent lock provided by the present invention is able to be adapted to the mechanical structure of the original drawer or the cabinet door which adopts the lock cylinder; through simple and single-return mechanical clutching, and with the easiest installation procedure, without replacement or modification of drawers and cabinet doors, traditional standard locks are changed into intelligent locks without wiring. At the same time, after installing the intelligent lock, in addition to using the original key for unlocking, the smart phone is also able to be used to control and collect data, and the data are able to be uploaded to the cloud internet database through the smart terminal.

Element symbols are described as follows:

11: locking head; 12: springback lock tongue; 13: first round rotary table; 14: fixed seat; 15: reset spring; 120: first curved guide rail; 121: second curved guide rail; 122: convex column; 131: first positioning bulge; 141: spring groove; 21: PCB; 22: motor; 23: scalable suite; 24: second round rotary table; 25: panel casing; 26: bottom casing; 271: left baffle; 272: right baffle; 28: battery cover; 19: lamp holder; 231: outer suite; 232: inner suite; 241: second positioning bulge.

DETAILED DESCRIPTION OF THE PREFERRED EMBODIMENT

To more clearly describe the present invention, the present invention is further explained with accompanying drawings as follows.

Figure 1:
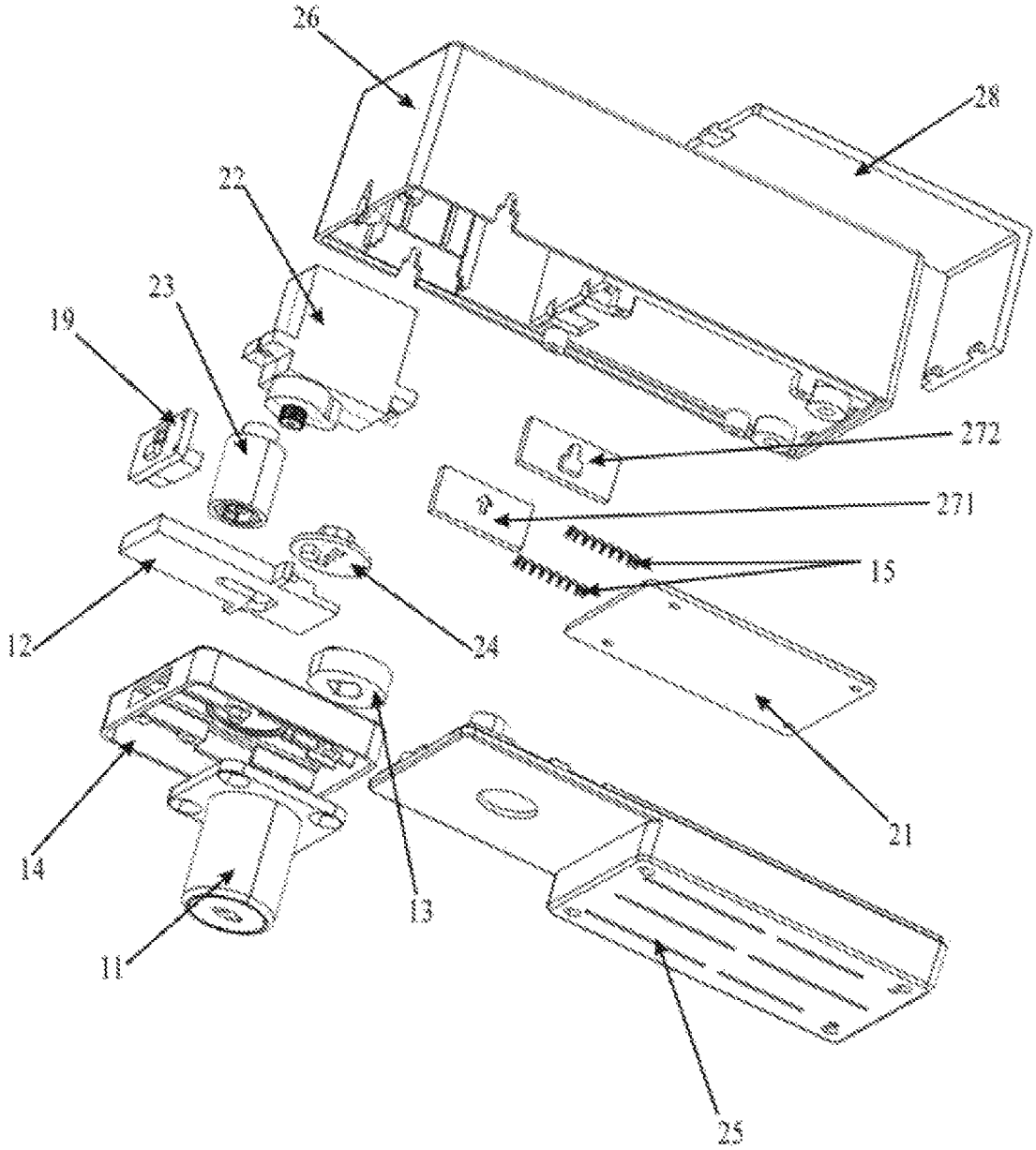
FIG. 1 is an explosive view of a household electric and mechanical dual-controlled intelligent lock provided by the present invention.
Figure 2:
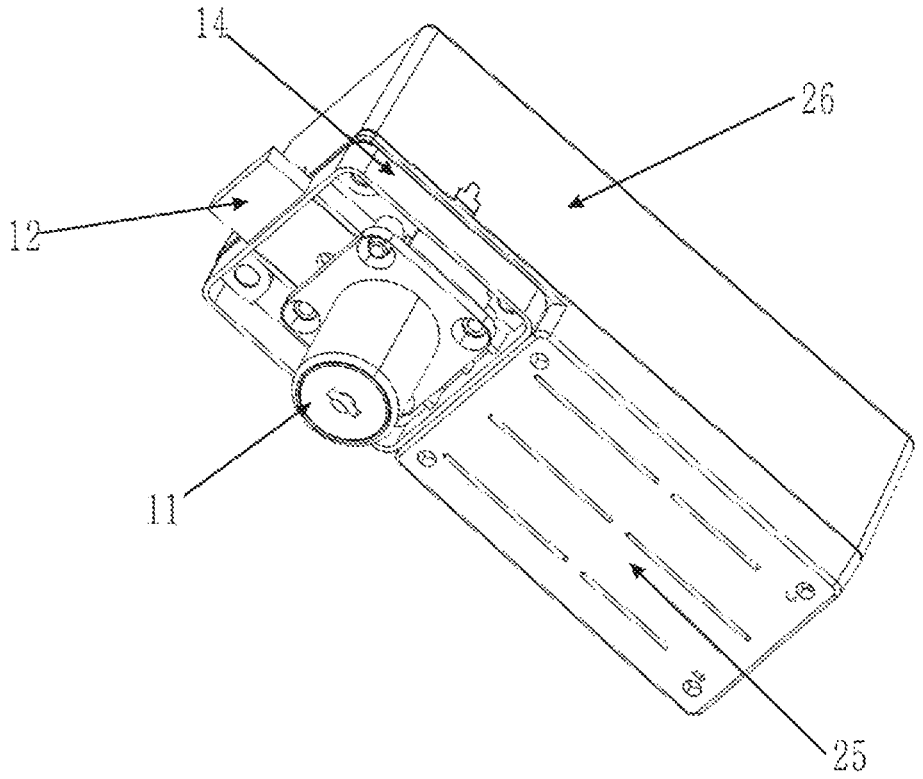
FIG. 2 is a structurally schematic view of the household electric and mechanical dual-controlled intelligent lock provided by the present invention.
Figure 3:
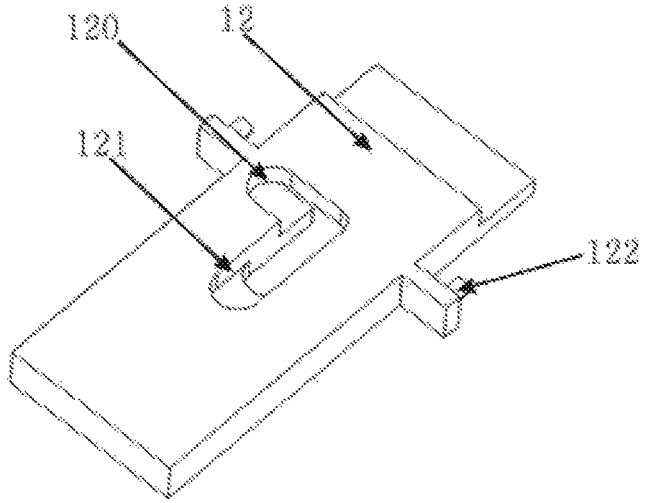
FIG. 3 is a partially schematic view of a springback lock tongue of the household electric and mechanical dual-controlled intelligent lock provided by the present invention.
Figure 4:
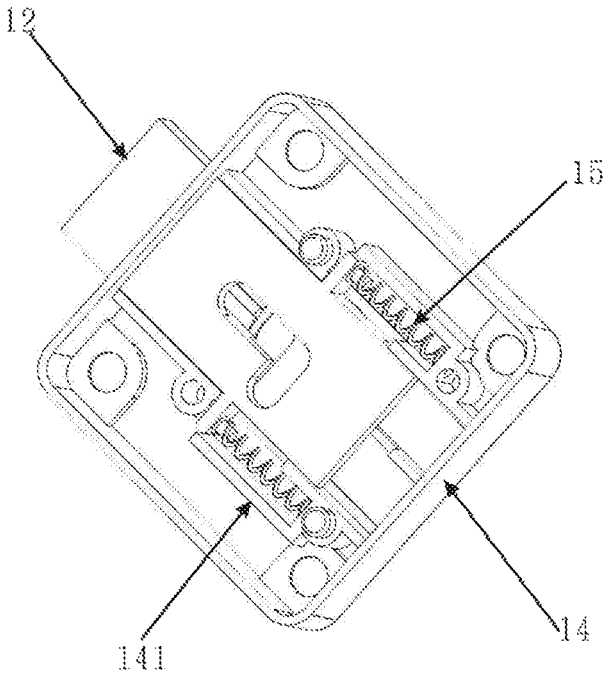
FIG. 4 is a partially schematic view of a fixed seat of the household electric and mechanical dual-controlled intelligent lock provided by the present invention.
Figure 5:
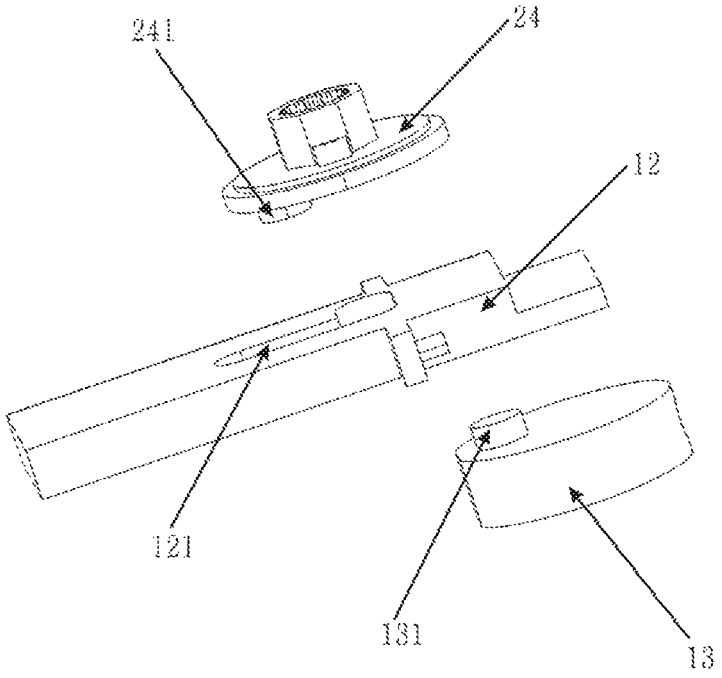
FIG. 5 is a partially explosive view of a first round rotary table and a second round rotary table of the household electric and mechanical dual-controlled intelligent lock provided by the present invention.
Figure 6:
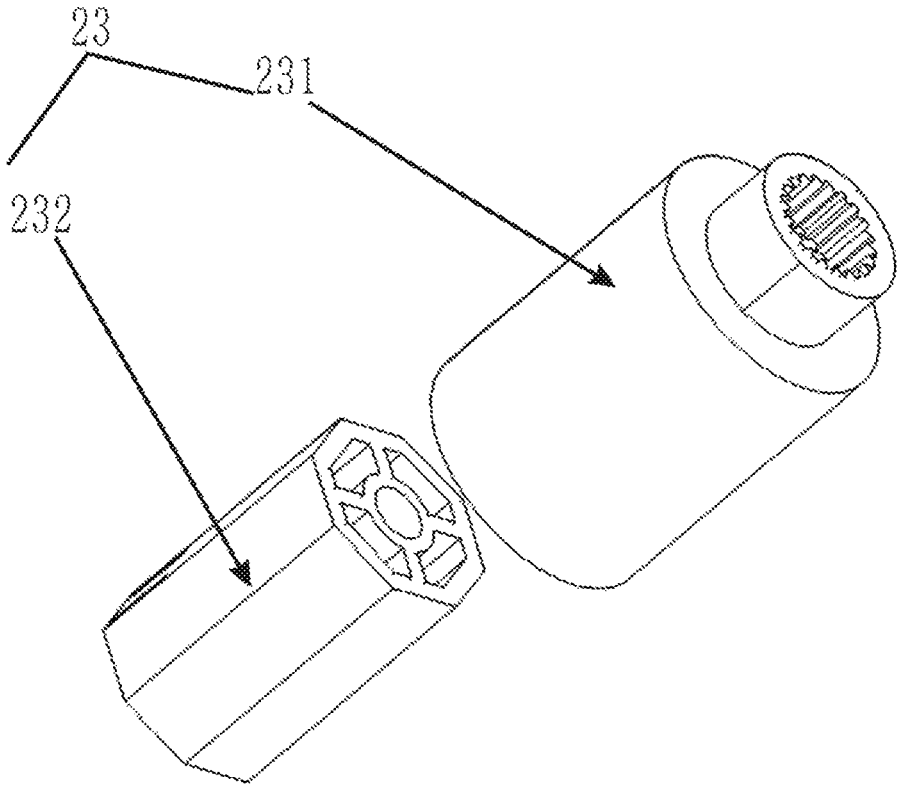
FIG. 6 is a partially explosive view of a scalable suite of the household electric and mechanical dual-controlled intelligent lock provided by the present invention.

Referring to FIGS. 1 to 3, a household electric and mechanical dual-controlled intelligent lock according to a preferred embodiment of the present invention is illustrated, which comprises a mechanical clutching structure and an intelligent electronic control structure. The mechanical clutching structure comprises a locking head 11, a springback lock tongue 12, a first round rotary table 13 and a fixed seat 14, wherein: the springback lock tongue 12 is fixed on the fixed seat 14, an end portion of the springback lock tongue 12 extends outside the fixed seat 14, a first arched guide rail 120 which is fitted with the first round rotary table 13 is located on one surface of the springback lock tongue 12, the locking head 11 is connected with the springback lock tongue 12 through the first round rotary table 13; when a key is inserted into the locking head 11 for rotating to drive the first round rotary table 13 to rotate, the end portion of the springback lock tongue 12 is retracted into the fixed seat 14.

The intelligent electronic control structure comprises a PCB (printed circuit board) 21, a motor 22, a scalable suite 23 and a second round rotary table 24, wherein: the PCB 21 is electrically connected with the motor 22, one end of the scalable suite 23 is fixedly connected with the motor 22, the other end of the scalable suite 23 is fixedly connected with the second round rotary table 24, a second arched guide rail 121 which is fitted with the second round rotary table 24 is located on the other surface of the springback lock tongue 12; the PCB 21 controls the motor 22 to work, the scalable suite 23 drives the second round rotary table 24 to rotate, so that the end portion of the springback lock tongue 12 is retracted into the fixed seat 14.

Compared with the prior art, the intelligent lock provided by the present invention is able to be adapted to the mechanical structure of the original drawer or the cabinet door which adopts the lock cylinder; through simple and single-return mechanical clutching, and with the easiest installation procedure, without replacement or modification of drawers and cabinet doors, traditional standard locks are changed into intelligent locks without wiring. At the same time, after installing the intelligent lock, in addition to using the original key for unlocking, the smart phone is also able to be used to control and collect data, and the data are able to be uploaded to the cloud internet database through the smart terminal.

The mechanical clutching structure further comprises two reset springs 15, wherein: the fixed seat 14 has two spring grooves 141 for respectively installing the two reset springs 15, two convex columns 122 are respectively located at two side walls of the springback lock tongue 12 for holding the two reset springs 15, one end of each of the two reset springs 15 presses against a groove wall of one of the two spring grooves 141; the other end of each of the two reset springs 15 is sleeved outside one of the two convex columns 122 and presses against one of the two reset springs 15; when the two reset springs 15 are compressed, the end portion of the springback lock tongue 12 is retracted into the fixed seat 14; when the two reset springs 15 are stretched, the end portion of the springback lock tongue 12 extends outside the fixed seat 14.

Preferably, a first positioning bulge 131 which is fitted with the springback lock tongue 12 is located at one surface of the first round rotary table 13, a square slot which is fitted with the locking head 11 is provided on the other surface of the first round rotary table 13; a second positioning bulge 241 which is fitted with the springback lock tongue 12 is located at one surface of the second round rotary table 24, an inner threaded structure which is fitted with the scalable suite 23 is located on the other surface of the second round rotary table 24.

Preferably, the scalable suite 23 comprises an outer suite 231 and an inner suite 232, wherein: the outer suite 231 has a columnar structure which is round outside but square inside; an external surface of the inner suite 232 is a square surface which is fitted with an inner surface of the outer suite 231, one end portion of the outer suite 231 has an inner gear structure which is fitted with the motor 22, one end portion of the inner suite 232 which is opposite to the outer suite 231 has an outer threaded structure fitted with the second round rotary table 24.

Preferably, the intelligent electronic control structure further comprises a panel casing 25 and a bottom casing 26, wherein the PCB 21, the motor 22, the scalable suite 23 and the second round rotary table 24 are accommodated within a cavity which is formed by enclosing the panel casing 25 and a bottom casing 26; the panel casing 25 has a through-hole for allowing the second round rotary table 24 to pass through; the fixed seat 14 is fixed to an external surface of the panel casing 25 through removable screws, the second round rotary table 24 passes through the through-hole and then is snapped into the second curved guide rail 121 located on the springback lock tongue 12.

Preferably, the intelligent electronic control structure further comprises a left baffle 271 and a right baffle 272 which are respectively fixed at two sides of the panel casing 25, two peak-shaped bumps are respectively located at an external surface of the left baffle 271 and the right baffle 272, two peak-shaped slots which are respectively fitted with the two peak-shaped bumps of the left baffle 271 and the right baffle 272 are provided on two side walls of the bottom casing 26, the bottom casing 26 is accurately fixedly connected with the panel casing 5 through inserting the left baffle 271 and the right baffle 272 into the bottom casing 26.

Preferably, the intelligent electronic control structure further comprises a battery, the panel casing 25 has a battery slot, the battery is inserted into the battery slot and is electrically connected with the PCB 21, a battery cover 28 is located above the bottom casing 26 for easily replacing the battery, the battery cover 28 is in removable fixed connection with the bottom casing 26.

Preferably, the intelligent electronic control structure further comprises a lamp holder 19 which comprises an LED (light emitting diode) indicator lamp, an infrared distance sensor, a photometric sensor and a control button, wherein the LED indicator lamp, the infrared distance sensor, the photometric sensor and the control button are electrically connected with the PCB 21 and extend outside a surface of the bottom casing 26.

The PCB 21 comprises an information sending module for sending a letter prompt message to an external mobile intelligent terminal, a wireless connection module is a Bluetooth connection module or a LAN connection module.

The above disclosure is only a few specific embodiments of the present invention, but is not the limitation to the present invention, and any changes that can be considered by those skilled in the art should fall within the protection scope of the present invention.

What is claimed is:

1. A household electric and mechanical dual-controlled intelligent lock, which comprises a mechanical clutching structure and an intelligent electronic control structure, wherein:

the mechanical clutching structure comprises a locking head, a springback lock tongue, a first round rotary table and a fixed seat, wherein: the springback lock tongue is fixed on the fixed seat, an end portion of the springback lock tongue extends outside the fixed seat, a first arched guide rail which is fitted with the first round rotary table is located on one surface of the springback lock tongue, the locking head is connected with the springback lock tongue through the first round rotary table, so that when a key is inserted into the locking head for rotating to drive the first round rotary table to rotate, the end portion of the springback lock tongue is retracted into the fixed seat;

the intelligent electronic control structure comprises a PCB (printed circuit board), a motor, a scalable suite and a second round rotary table, wherein: the PCB is electrically connected with the motor, one end of the scalable suite is fixedly connected with the motor, the other end of the scalable suite is fixedly connected with the second round rotary table, a second arched guide rail which is fitted with the second round rotary table is located on the other surface of the springback lock tongue; the PCB controls the motor to work, the scalable suite drives the second round rotary table to rotate, so that the end portion of the springback lock tongue is retracted into the fixed seat.

2. The household electric and mechanical dual-controlled intelligent lock, as recited in claim 1, wherein: the mechanical clutching structure further comprises two reset springs, wherein: the fixed seat has two spring grooves for respectively installing the two reset springs, two convex columns are respectively located at two side walls of the springback lock tongue for holding the two reset springs, one end of each of the two reset springs presses against a groove wall of one of the two spring grooves, the other end of each of the two reset springs is sleeved outside one of the two convex columns and presses against one of the two reset springs, so that when the two reset springs are compressed, the end portion of the springback lock tongue is retracted into the fixed seat; when the two reset springs are stretched, the end portion of the springback lock tongue extends outside the fixed seat.

3. The household electric and mechanical dual-controlled intelligent lock, as recited in claim 1, wherein: a first positioning bulge which is fitted with the springback lock tongue is located at one surface of the first round rotary table, a square slot which is fitted with the locking head is provided on the other surface of the first round rotary table; a second positioning bulge which is fitted with the springback lock tongue is located at one surface of the second round rotary table, an inner threaded structure which is fitted with the scalable suite is located on the other surface of the second round rotary table.

4. The household electric and mechanical dual-controlled intelligent lock, as recited in claim 3, wherein: the scalable suite comprises an outer suite and an inner suite, wherein: the outer suite has a columnar structure which is round outside but square inside, an external surface of the inner suite is a square surface which is fitted with an inner surface of the outer suite, one end portion of the outer suite has an inner gear structure which is fitted with the motor, an end portion of the inner suite which is opposite to the outer suite has an outer threaded structure fitted with the second round rotary table.

5. The household electric and mechanical dual-controlled intelligent lock, as recited in claim 1, wherein: the intelligent electronic control structure further comprises a panel casing and a bottom casing, wherein the PCB, the motor, the scalable suite and the second round rotary table are accommodated within a cavity which is formed by enclosing the panel casing and a bottom casing; the panel casing has a through-hole for allowing the second round rotary table to pass through; the fixed seat is fixed to an external surface of the panel casing through removable screws, the second round rotary table passes through the through-hole and then is snapped into the second arched guide rail located on the springback lock tongue.

6. The household electric and mechanical dual-controlled intelligent lock, as recited in claim 5, wherein: the intelligent electronic control structure further comprises a left baffle and a right baffle which are respectively fixed at two sides of the panel casing, two peak-shaped bumps are respectively located at an external surface of the left baffle and the right baffle, two peak-shaped slots which are respectively fitted with the two peak-shaped bumps of the left baffle and the right baffle are provided on two side walls of the bottom casing, the bottom casing is accurately fixedly connected with the panel casing through inserting the left baffle and the right baffle into the bottom casing.

* * * * *